US011129509B2

(12) United States Patent
Kim et al.

(10) Patent No.: US 11,129,509 B2
(45) **Date of Patent: *Sep. 28, 2021**

(54) ROBOT CLEANER

(71) Applicant: SAMSUNG ELECTRONICS CO., LTD., Suwon-si (KR)

(72) Inventors: Sin Ae Kim, Suwon-si (KR); Young Jae Park, Suwon-si (KR); Keon Soo Choi, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 309 days.

This patent is subject to a terminal disclaimer.

(21) Appl. No.: 16/152,718

(22) Filed: Oct. 5, 2018

(65) Prior Publication Data

US 2019/0029483 A1 Jan. 31, 2019

Related U.S. Application Data

(63) Continuation of application No. 15/505,506, filed as application No. PCT/KR2015/008684 on Aug. 20, 2015, now Pat. No. 10,130,227.

(30) Foreign Application Priority Data

Aug. 21, 2014 (KR) ..... 10-2014-0108970

(51) Int. Cl.
*A47L 5/22* (2006.01)
*A47L 11/20* (2006.01)
(Continued)

(52) U.S. Cl.
CPC ..... *A47L 9/1633* (2013.01); *A47L 5/22* (2013.01); *A47L 9/02* (2013.01); *A47L 9/0477* (2013.01);
(Continued)

(58) Field of Classification Search
CPC ..... A47L 9/1633; A47L 9/02; A47L 9/102; A47L 9/165; A47L 9/0477; A47L 9/1608;
(Continued)

(56) References Cited

U.S. PATENT DOCUMENTS 9,801,515 B2 10/2017 Kim
2013/0305484 A1 11/2013 Dyson et al.

FOREIGN PATENT DOCUMENTS

JP 2012-245344 12/2012
KR 10-0623916 9/2006
(Continued)

OTHER PUBLICATIONS

Chinese Office Action dated Nov. 15, 2018 in Chinese Patent Application No. 201580055169.X.
(Continued)

*Primary Examiner* — David Redding
(74) *Attorney, Agent, or Firm* — Staas & Halsey, LLP

(57) ABSTRACT

There is provided a robot cleaner having an improved dust-collecting capability and an improved suction force and capable of being manufactured in a small size. The robot cleaner includes a main body comprising a fan motor and having a suction port provided in one side thereof; a plurality of cyclone units configured to separate foreign substances in air suctioned through the suction port; and a plurality of suction flow paths connecting the plurality of cyclone units and the suction port.

10 Claims, 6 Drawing Sheets

(51) Int. Cl.

| | |
|---|---|
| ***B04C 9/00*** | (2006.01) |
| ***A47L 9/02*** | (2006.01) |
| ***A47L 9/10*** | (2006.01) |
| ***A47L 9/28*** | (2006.01) |
| ***A47L 9/04*** | (2006.01) |
| ***A47L 9/16*** | (2006.01) |
| *A47L 1/16* | (2006.01) |

(52) U.S. Cl.
CPC ..... *A47L 9/102* (2013.01); *A47L 9/165* (2013.01); *A47L 9/1608* (2013.01); *A47L 9/1641* (2013.01); *A47L 9/1666* (2013.01); *A47L 9/1683* (2013.01); *A47L 9/28* (2013.01); *A47L 11/20* (2013.01); *B04C 9/00* (2013.01); *A47L 2201/00* (2013.01); *A47L 2201/04* (2013.01)

(58) Field of Classification Search
CPC .... A47L 9/1641; A47L 9/1666; A47L 9/1683; A47L 5/22; A47L 9/28; A47L 11/20; A47L 2201/00; A47L 2201/04; B04C 9/00
See application file for complete search history.

(56) References Cited

FOREIGN PATENT DOCUMENTS

| | | |
|---|---|---|
| KR | 10-0623916 B1 | 9/2006 |
| KR | 10-2014-0096610 | 8/2014 |
| WO | WO 94/00046 | 1/1994 |

OTHER PUBLICATIONS

International Search Report dated Nov. 4, 2015 in corresponding International Application No. PCT/KR2015/008684.
Extended European Search Report dated Jan. 9, 2018, in corresponding European Patent Application No. 15833520.8.
Australian Notice of Acceptance dated Feb. 19, 2018 in corresponding Australian Patent Application No. 2015304178.
Australian Office Action dated Oct. 20, 2017 in corresponding Australian Patent Application No. 2015304178.
European Communication under Rule 71(3) dated Jun. 28, 2018 in European Patent Application No. 15833520.8.
U.S. Notice of Allowance dated Aug. 15, 2018 in U.S. Appl. No. 15/505,506.
U.S. Office Action dated Apr. 5, 2018 in U.S. Appl. No. 15/505,506.
U.S. Appl. No. 15/505,506, filed Feb. 21, 2017, Sin Ae Kim, et al., Samsung Electronics Co., Ltd.
Korean Office Action dated Oct. 19, 2020, in corresponding Korean Patent Application No. 10-2014-0108970.
Korean Office Action for Korean Patent Application No. 10-2014-0108970 dated Apr. 9, 2021 (5 pages including translation).
Korean Office Action for Korean Patent Application No. 10-2014-0108970 dated Jun. 7, 2021 (5 pages including translation).

[Fig. 1]
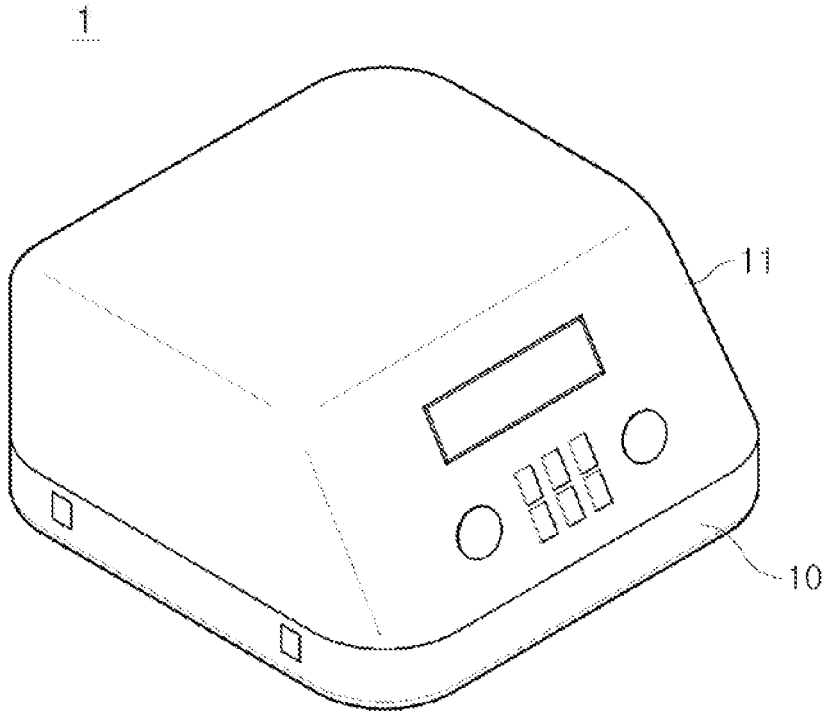
[Fig. 2]
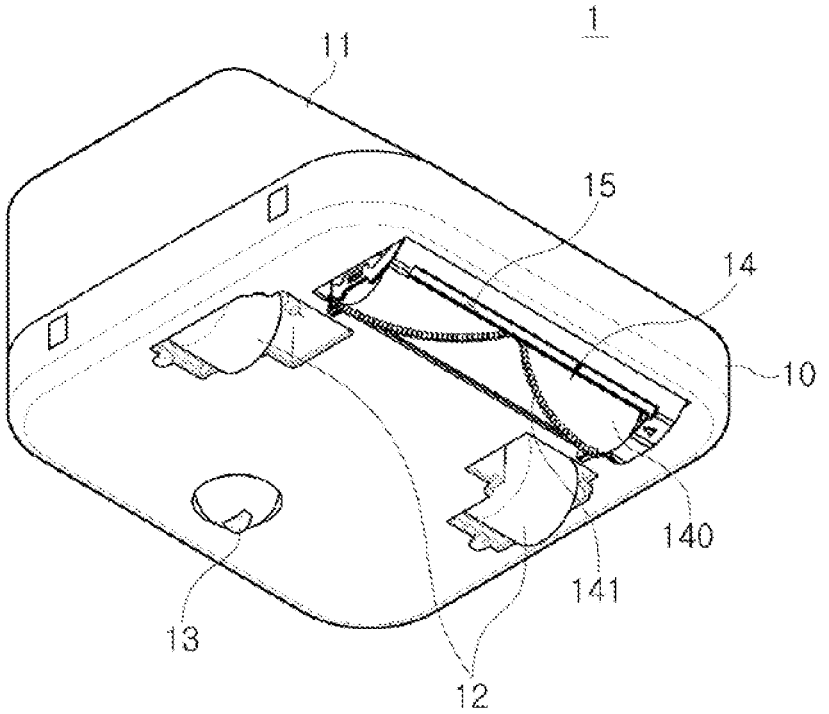

[Fig. 3]
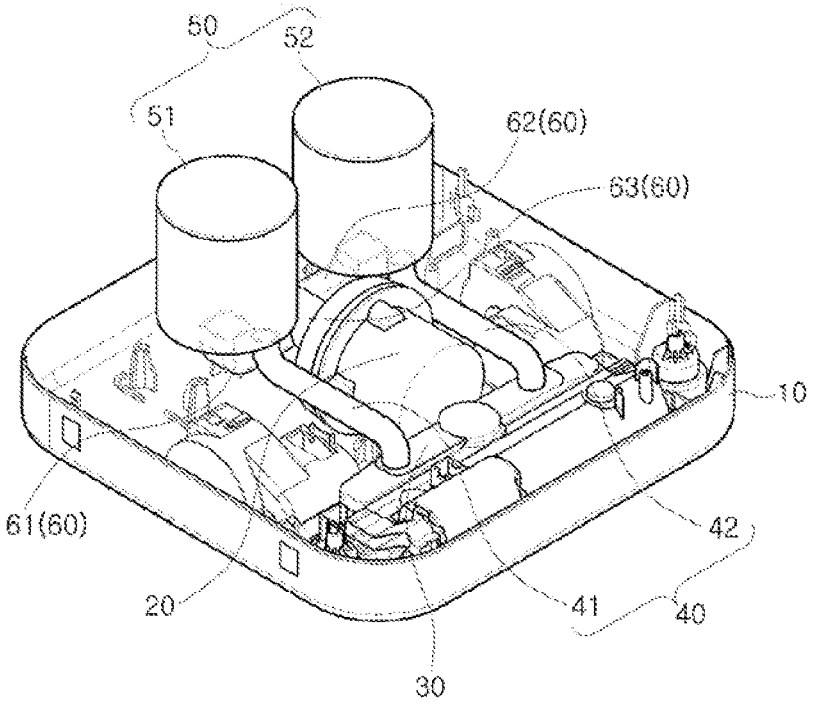
[Fig. 4]
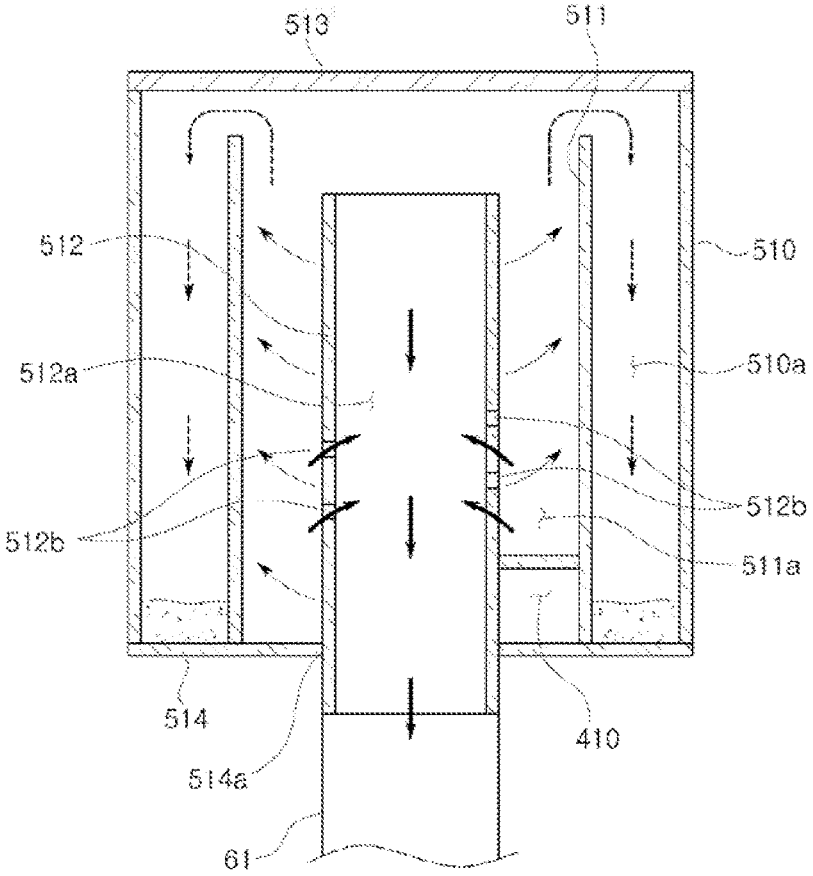

[Fig. 5]
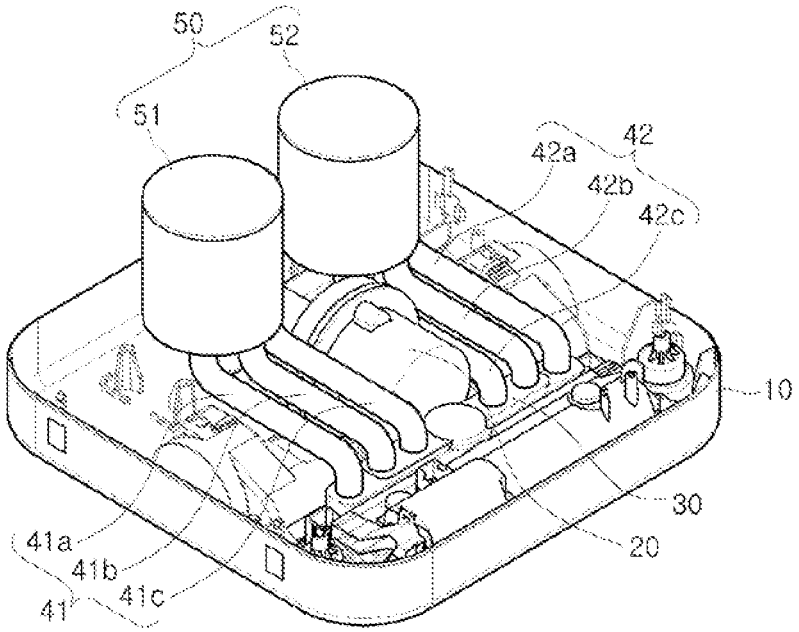
[Fig. 6]
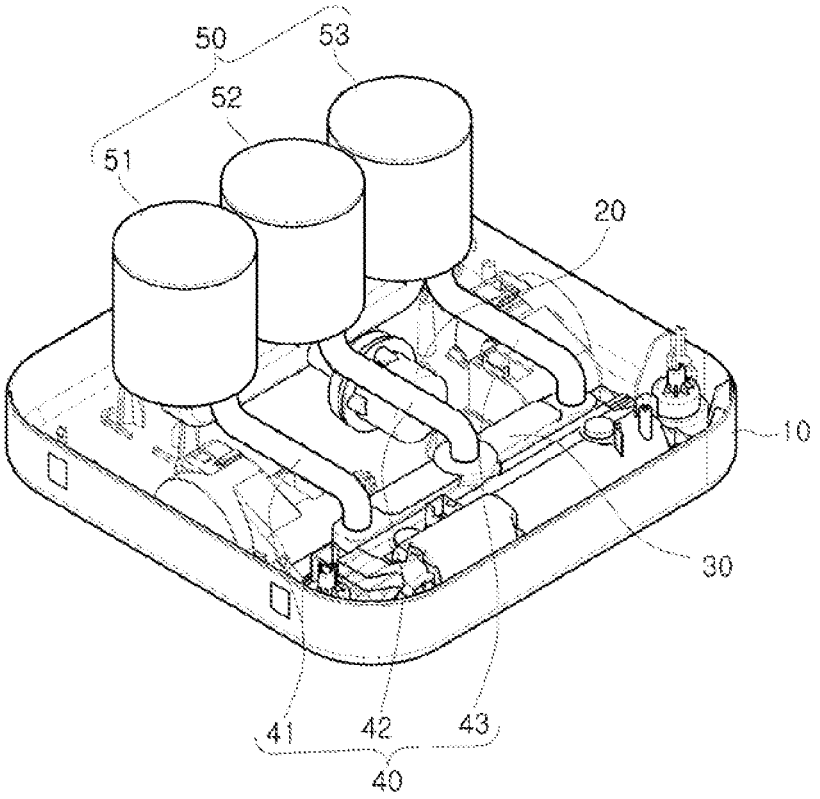

[Fig. 7]
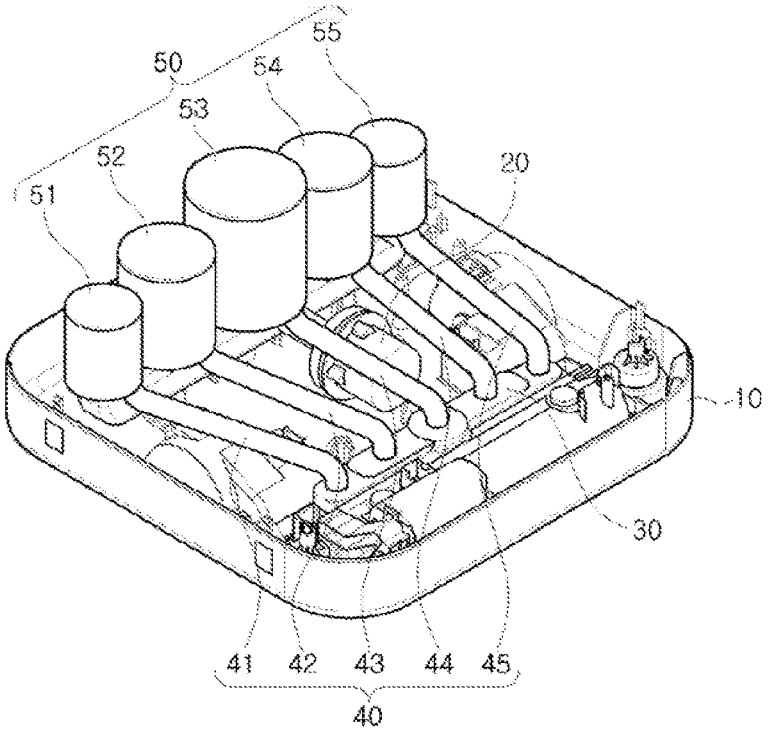
[Fig. 8]
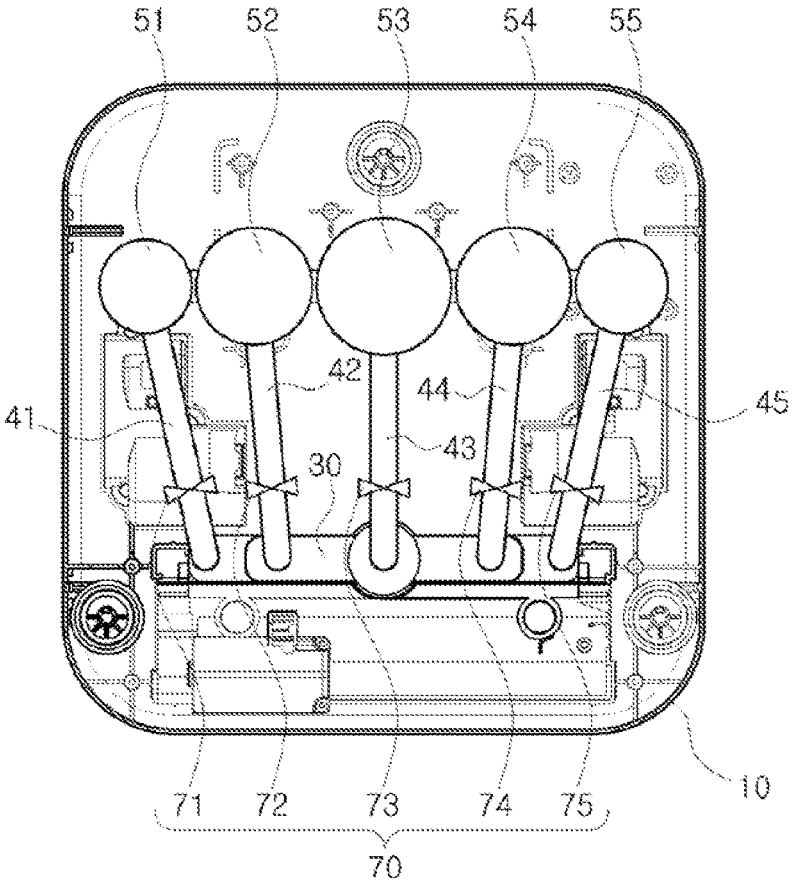

[Fig. 9]
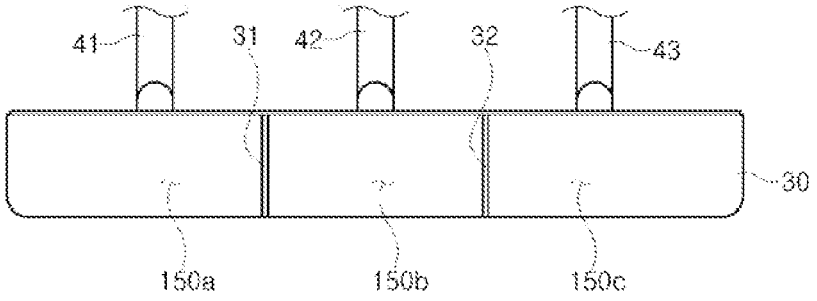
[Fig. 10]
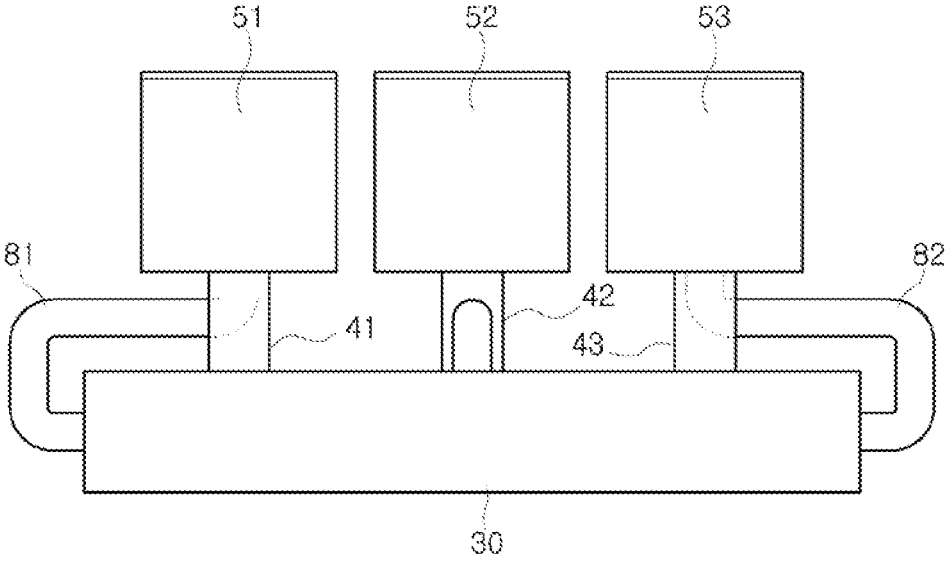

[Fig. 11]
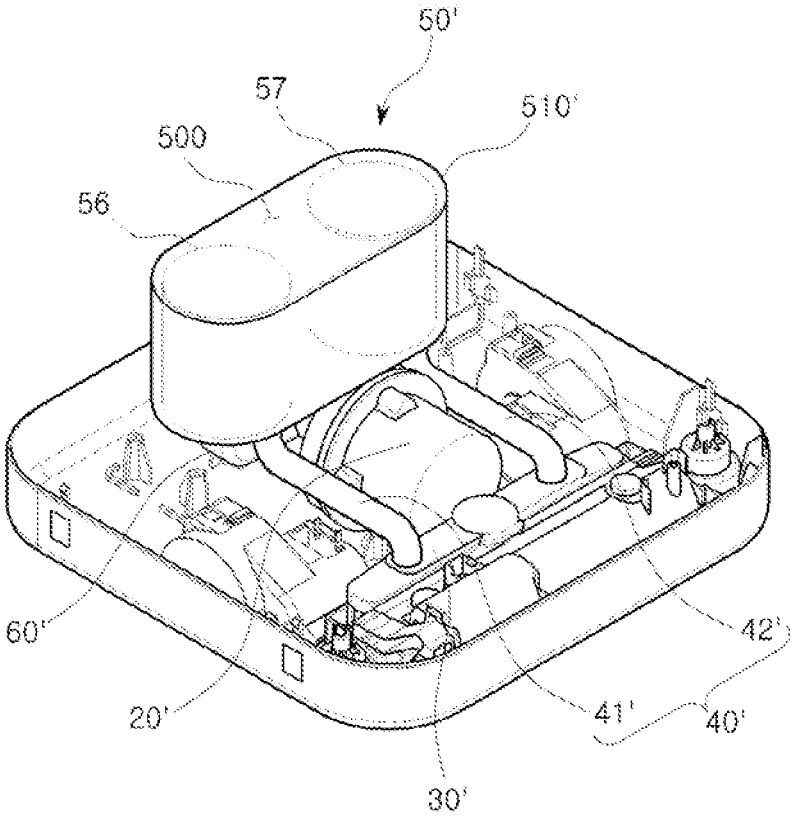
[Fig. 12]
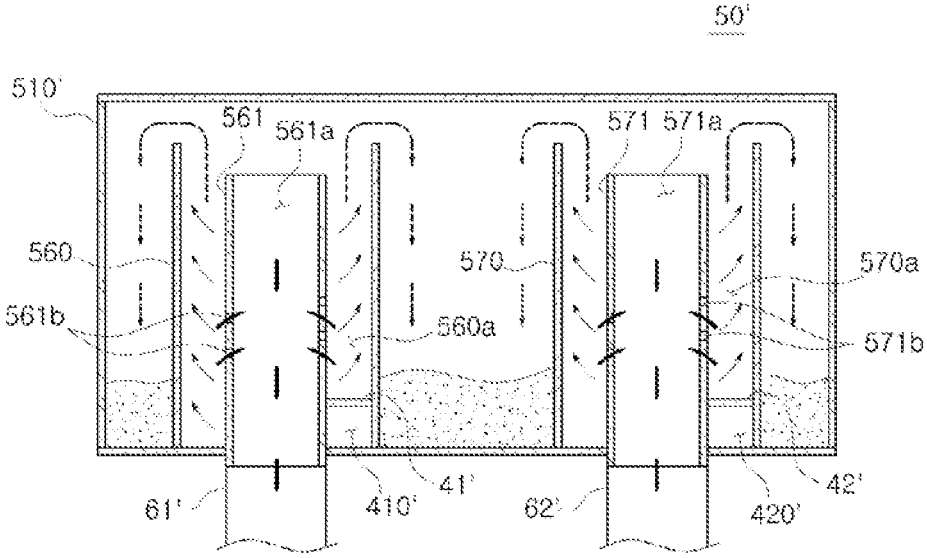

ROBOT CLEANER

CROSS-REFERENCE TO RELATED APPLICATIONS

This application is a continuation application of U.S. patent application Ser. No. 15/505,506, filed on Feb. 21, 2017, which is a U.S. National Stage Application, which claims the benefit under 35 U.S.C. § 371 of PCT International Patent Application No. PCT/KR2015/008684, filed Aug. 20, 2015, which claims the foreign priority benefit under 35 U.S.C. § 119 of Korean Patent Application No. 10-2014-0108970, filed Aug. 21, 2014, the contents of which are incorporated herein by reference.

TECHNICAL FIELD

The present invention relates to a robot cleaner having improved cleaning efficiency.

BACKGROUND ART

Robot cleaners are apparatuses that suction foreign substances such as dust from a floor surface while traveling in an area to be cleaned without user's manipulation so as to perform a cleaning operation. Robot cleaners determine a distance to obstacles such as furniture, office supplies, walls installed in the area to be cleaned using a distance sensor and drive a left-wheel motor and a right-wheel motor of a robot cleaner selectively to clean the area to be cleaned while changing a direction.

A suction unit is disposed on a bottom surface of the robot cleaner, and dust on the floor surface is suctioned by the suction unit. A suction motor is provided in the robot cleaner and supplies a suction force so that dust on the floor surface can be suctioned by the suction unit. A main brush is rotatably provided at the suction unit to pick up dust on the floor surface.

Dust suctioned by the suction unit can be accommodated in a dust collector. A filter is provided at one side of the dust collector. The filter filters air suctioned into a suction motor side and discharges the air. When cleaning of the floor surface is performed by the robot cleaner for a long time, the foreign substances are filtered by the filter such that the filter may be clogged. When the filter is clogged, the suctioned air does not easily pass through the filter so that the suction force generated by the suction motor may be reduced and cleaning efficiency may be degraded.

In order to solve the problem of a lowered suction force, applying a cyclone dust collector to the robot cleaner may be considered. The cyclone dust collector is required to be manufactured in an appropriate ratio and an appropriate size so as to have a small pressure loss and high dust-collecting efficiency.

DISCLOSURE

Technical Problem

The present invention is directed to providing a robot cleaner having an improved dust-collecting capability and an improved suction force and capable of being manufactured in a small size.

Technical Solution

In accordance with an embodiment of the present invention, a robot cleaner includes a main body comprising a fan motor and having a suction port provided in one side thereof; a plurality of cyclone units configured to separate foreign substances in air suctioned through the suction port; and a plurality of suction flow paths connecting the plurality of cyclone units and the suction port.

The plurality of suction flow paths may be connected to a suction unit that communicates with the suction port.

The plurality of suction flow paths may be respectively connected at different locations on the suction unit.

A space of the suction unit may be partitioned by partition walls.

At least one suction flow path may be connected to each of spaces partitioned by the partition walls.

The robot cleaner may further include a discharge circulation flow path in which movement of air discharged from the cyclone units is guided.

The discharge circulation flow path may be connected to the suction unit.

The discharge circulation flow path may be connected to a rear end of the fan motor.

The number of the plurality of suction flow paths and the number of the plurality of cyclone units may be different from each other.

The number of the plurality of suction flow paths may be the same as the number of the plurality of cyclone units.

At least one suction flow path may be connected to each of the plurality of cyclone units.

The plurality of cyclone units may have different sizes.

On/off of each of the plurality of cyclone units may be controlled.

The robot cleaner may further include a valve configured to turn on/off each of the plurality of cyclone units.

The robot cleaner may further include a dust box, which is provided outside the cyclone units and in which the foreign substances in air is accommodated.

In accordance with an embodiment of the present invention, a robot cleaner includes a main body comprising a fan motor that generates a suction force and having a suction port provided in one side thereof; a plurality of cyclone units provided in the main body; a dust box in which the plurality of cyclone units are accommodated; a plurality of suction flow paths connecting the plurality of cyclone units and the suction port; and a discharge flow path connecting the cyclone units and the fan motor.

The suction flow path may be connected to a suction unit that communicates with the suction port.

The plurality of suction flow paths may be respectively connected at different locations on the suction unit.

The number of the plurality of suction flow paths may be the same as the number of the plurality of cyclone units.

At least one suction flow path may be connected to each of the plurality of cyclone units.

In accordance with an embodiment of the present invention, a robot cleaner includes a main body comprising a fan motor that generates a suction force and having a suction port provided in one side thereof; a plurality of cyclone units configured to separate foreign substances in air suctioned through the suction port; and at least one suction flow path connecting the plurality of cyclone units and the suction port.

The suction flow path may be connected to a suction unit provided to communicate with the suction port.

A plurality of suction flow paths may be connected to the plurality of cyclone units, and the plurality of suction flow paths are respectively connected at different locations on the suction unit.

The robot cleaner may further include a discharge circulation flow path connecting a rear end of the fan motor and the suction unit.

A space of the suction unit may be partitioned by partition walls.

A plurality of suction flow paths may be connected to at least one of the plurality of cyclone units.

The the plurality of cyclone units may have different sizes so that they accommodate foreign substances having different sizes.

The plurality of cyclone units may be controlled to be individually turned on/off.

The robot cleaner may further include a discharge flow path connecting the cyclone units and a front end of the fan motor.

A filter may be provided at a front end or rear end of the fan motor.

Advantageous Effects

In a robot cleaner according to an embodiment of the present invention, a plurality of cyclone dust collectors are disposed so that a dust-collecting capability and a suction force are improved, space utilization is improved and thus a slim robot cleaner can be realized.

DESCRIPTION OF DRAWINGS

FIG. 1 is a perspective view of a robot cleaner according to an embodiment of the present invention.

FIG. 2 is a bottom perspective view of the robot cleaner according to an embodiment of the present invention.

FIG. 3 is a view of a state in which a top cover of the robot cleaner according to an embodiment of the present invention is removed.

FIG. 4 is a cross-sectional view of a cyclone dust collector according to an embodiment of the present invention.

FIG. 5 is a view of a state in which a plurality of suction flow paths are connected to the cyclone dust collector according to an embodiment of the present invention.

FIG. 6 is a view of a state in which a plurality of cyclone dust collectors are provided in the robot cleaner according to an embodiment of the present invention.

FIG. 7 is a view of a state in which cyclone dust collectors having different sizes are provided in the robot cleaner according to an embodiment of the present invention.

FIG. 8 is a view of a state in which a valve is mounted in a suction flow path connected to a plurality of cyclone dust collectors provided in the robot cleaner according to an embodiment of the present invention.

FIG. 9 is a view of a state in which partition walls are provided in the inlet of the robot cleaner according to an embodiment of the present invention.

FIG. 10 is a view of a state in which a discharge flow path is connected to an inlet of the robot cleaner according to an embodiment of the present invention.

FIG. 11 is a view of a state in which a plurality of cyclone dust collectors provided in the robot cleaner, according to another embodiment of the present invention, share a foreign substance collecting unit.

FIG. 12 is a cross-sectional view of the plurality of cyclone dust collectors of the robot cleaner that share the foreign substance collecting unit, according to another embodiment of the present invention.

BEST MODE OF THE INVENTION

Hereinafter, a robot cleaner according to embodiments of the present invention will be described in detail with reference to the attached drawings.

FIG. 1 is a perspective view of a robot cleaner according to an embodiment of the present invention, FIG. 2 is a bottom perspective view of the robot cleaner according to an embodiment of the present invention, and FIG. 3 is a view of a state in which a top cover of the robot cleaner according to an embodiment of the present invention is removed.

Referring to FIGS. 1 to 3, a robot cleaner 1 according to an embodiment of the present invention includes a main body in which a fan motor 20 and a cyclone dust collector 50 are accommodated. The main body includes a base 10 in which the fan motor 20 and the cyclone dust collector 50 are accommodated, and a top cover 11 that covers an upper portion of the base 10.

The robot cleaner 1 may travel due to wheels 12. The wheels 12 may be provided at both sides of the main body. The wheels 12 may be driven by a motor, may rotate clockwise or counterclockwise so that the robot cleaner 1 travels in various directions.

A caster 13 may be provided at a bottom surface of the robot cleaner 1 and may travel in all directions. The caster 13 may be provided at the front or the rear of robot cleaner 1. The robot cleaner 1 may be stably supported by two wheels 12 and one or more casters 13. Also, traveling of the robot cleaner 1 and changing a traveling direction may be smoothly performed by the caster 13 which may travel in all directions.

A brush assembly 14 may be provided in the robot cleaner 1 and may pick up foreign substances on the floor surface. The brush assembly 14 may be rotatably provided at a suction port 15 formed in the base 10. The brush assembly 14 may include a shaft 140 that is rotatably provided and a brush 141 that is disposed on an outer circumferential surface of the shaft 140. The foreign substances picked up by the brush assembly 14 may be moved to a dust collector 50 through a suction flow path 40 due to a suction force of the fan motor 20.

A suction unit 30 may be provided at the suction port 15. The suction unit 30 may be disposed at the suction port 15 and may guide air introduced through the suction port 15 to the suction flow path 40. The suction unit 30 may be provided to communicate with the suction port 15.

The suction port 15 may be disposed at the front of the base 10 and may be long in a left/right direction, and the suction unit 30 may extend along the suction port 14. The suction port 15 may be long in the left/right direction so that a maximum area may be cleaned by a minimum movement distance of the robot cleaner 1.

The suction unit 30 may have a shape of a case having an open bottom surface. The brush assembly 14 may be rotatably mounted on the suction unit 30. The suction flow path 40 may be connected to the suction unit 30. An internal space of the suction unit 30 and the suction flow path 40 may communicate with each other.

The fan motor 20 generates a suction force. The foreign substances included in air suctioned by the fan motor 20 may be accommodated in the dust collector 50. The foreign substances introduced through the suction port 15 formed in the base 10 are separated from the air while passing through the cyclone dust collector 50. Thus, the foreign substances may be accommodated in the cyclone dust collector 50, and the air from which the foreign substances are separated, may be discharged from the cyclone dust collector 50 through a discharge flow path 60.

A filter may be further provided at the front end or the rear end of the fan motor 20. The filter may be provided in the discharge flow path 60 at the front end of the fan motor 20 so as to filter the air introduced into the fan motor 20 once again or may be provided in a separate discharge hole or the discharge flow path connected to the rear end of the fan motor 20 so as to filter the air that passes through the fan motor 20 once again. The filter provided at the front end or the rear end of the fan motor 20 may be a HEPA filter.

A plurality of cyclone dust collectors 50 may be provided. For example, the cyclone dust collector 50 may include a first cyclone dust collector 51 and a second cyclone dust collector 52. The first cyclone dust collector 51 and the second cyclone dust collector 52 each may be independently provided as separate components.

The suction flow path 40 may include a first suction flow path 41 and a second suction flow path 42. The first suction flow path 41 may be connected to the first cyclone dust collector 51, and the second suction flow path 42 may be connected to the second cyclone dust collector 52. The first suction flow path 41 and the second suction flow path 42 may be spaced a predetermined distance apart from each other and may be connected do the suction unit 30. That is, the first suction flow path 41 and the second suction flow path 42 may be respectively connected at different locations on the suction unit 30.

For example, when the suction unit 30 extends along the front of the base 10 in the left/right direction, the first suction flow path 41 may be connected closer to the left end of the suction unit 30 than the right end of the suction unit 30, and the second suction flow path 42 may be connected closer to the right end of the suction unit 30 than the left end of the suction unit 30.

A robot cleaner according to the related art has the problem in which a suction flow path is disposed at one side of a suction unit so that a suction force at a distant portion from the suction flow path is weakened. For example, when the suction flow path is connected to the central part of the suction unit, a suction force at both ends of the suction unit is weaker than a suction force at the central part of the suction unit.

However, in the robot cleaner according to the present invention, a plurality of suction flow paths are provided, are spaced apart from one another and are connected to the suction unit so that the problem of the robot cleaner according to the related art relating to the weakened suction force at the left and right ends of the suction unit can be solved.

The discharge flow path 60 may include a first discharge flow path 61 and a second discharge flow path 62. One side of the first discharge flow path 61 may be connected to the first cyclone dust collector 51, and one side of the second discharge flow path 62 may be connected to the second cyclone dust collector 52. The discharge flow path 60 may further include a third discharge flow path 63. One side of the third discharge flow path 63 may be connected to the fan motor 20, and the other side of the first discharge flow path 61 and the other side of the second discharge flow path 62 may be connected to the other side of the third discharge flow path 63.

The air from which foreign substances are separated by the first cyclone dust collector 51, may be discharged from the first cyclone dust collector 51 through the first discharge flow path 61, and the air from which foreign substances are separated by the second cyclone dust collector 52, may be discharged from the second cyclone dust collector 52 through the second discharge flow path 62. The air in the first discharge flow path 61 and the air in the second discharge flow path 62 may be combined in the third discharge flow path 63 and may move toward the fan motor 20. The air that moves toward the fan motor 20 may be discharged to the outside through a discharge hole formed in the fan motor 20 or a separate discharge flow path (not shown) connected to the fan motor 20.

When a conventional cyclone dust collector is applied to a robot cleaner, the size of the robot cleaner may be increased. When the size of the cyclone dust collector is reduced to maintain a compact size, like in a conventional robot cleaner, the dust-collecting performance of the cyclone dust collector may be degraded. Thus, a plurality of small-sized cyclone dust collectors are provided so that the dust-collecting performance can be improved and the robot cleaner having a compact size can be implemented. Also, because the plurality of suction flow paths are spaced apart from one another and are respectively connected at different locations on the suction unit, the problem relating to the weakened suction force at the left and right ends of the suction port can be solved.

FIG. 4 is a cross-sectional view of a cyclone dust collector according to an embodiment of the present invention.

Referring to FIG. 4, the cyclone dust collector 50 according to an embodiment of the present invention may generate a whirling air current to separate foreign substances from the air by centrifugal force. The air from which the foreign substances are separated, may be discharged to the outside through the discharge flow path 60, and the foreign substances may be accumulated in the cyclone dust collector 50.

Because the first cyclone dust collector 51 and the second cyclone dust collector 52 have similar configurations, hereinafter, the configuration of the first cyclone dust collector 51 will be described.

The first cyclone dust collector 51 may have an approximately cylindrical shape. The shape of the first cyclone dust collector 51 is not limited to the above description. Hereinafter, an embodiment in which the first cyclone dust collector 51 has an approximately cylindrical shape will be described.

The first cyclone dust collector 51 may include a dust box 510, a first cylindrical body 511, and a second cylindrical body 512. The dust box 510, the first cylindrical body 511, and the second cylindrical body 512 may be formed approximately concentric. The first cylindrical body 511 may be accommodated in the dust box 510, and the second cylindrical body 512 may be accommodated in the first cylindrical body 511. At least a part of the second cylindrical body 512 may be provided in the form of a grill part. A plurality of through holes 512*b* are formed in the grill part so that air may pass through the plurality of through holes 512*b*.

A space formed between the dust box 510 and the first cylindrical body 511 may be referred to as a first chamber 510*a*, and a space formed between the first cylindrical body 511 and the second cylindrical body 512 may be referred to as a second chamber 511*a*, and a space formed in the second cylindrical body 512 may be referred to as a third chamber 512*a*.

The first cyclone dust collector 51 may further include a top cover 513 and a bottom cover 514. The top cover 513 may cover an upper portion of the first cyclone dust collector 51, and the bottom cover 514 may cover a lower portion of the first cyclone dust collector 51.

A connection hole 514*a* may be formed in the bottom cover 514. The connection hole 514*a* may be formed in a side of the third chamber 512*a* so that the third chamber 512*a* and the first discharge flow path 61 may communicate with each other through the connection hole 514*a*.

The air that passes through the first suction flow path 41 may be introduced into the second chamber 511*a*. An inlet 410 that communicates with the first suction flow path 41 may be provided at a lower portion of the second chamber 511*a*. The air introduced into the second chamber 511*a* may turn along inner sidewalls of the first cylindrical body 511. The foreign substances in the air may be moved to the first chamber 510*a* and accommodated therein, and the air from which the foreign substances are separated, may be introduced into the third chamber 512*a* through the through holes 512*b* formed in the second cylindrical body 512. The air introduced into the third chamber 512*a* may be discharged through the first discharge flow path 61. The air from which the foreign substances are filtered by the first cyclone dust collector 52, may be moved to the fan motor 20 and discharged to the outside through the first discharge flow path 61.

The second cyclone dust collector 52 has a similar configuration to that of the first cyclone dust collector 52. The second cyclone dust collector 52 may filter the foreign substances in the air introduced through the second suction flow path 42 and discharge the air from which the foreign substances are filtered.

When some foreign substances are accommodated in the cyclone dust collector 50, a user may detach the upper cyclone dust collector 50 from the robot cleaner 1 or detach the top cover 513 from the first cyclone dust collector 51 so as to discard the foreign substances accommodated in the cyclone dust collector 50.

FIG. 5 is a view of a state in which a plurality of suction flow paths are connected to the cyclone dust collector according to an embodiment of the present invention.

Referring to FIG. 5, a plurality of cyclone dust collectors 50 according to an embodiment of the present invention may be provided, and a plurality of suction flow paths may be connected to at least one of the plurality of cyclone dust collectors.

When the cyclone dust collector 50 includes the first cyclone dust collector 51 and the second cyclone dust collector 52, the plurality of suction flow paths may be connected to at least one of the first cyclone dust collector 51 and the second cyclone dust collector 52.

A plurality of suction flow paths 41*a*, 41*b*, and 41*c* may be connected to the first cyclone dust collector 51, or a plurality of suction flow paths 42*a*, 42*b*, and 42*b* may be connected to the second cyclone dust collector 52, or a plurality of suction flow paths may be connected to the first cyclone dust collector 51 and the second cyclone dust collector 52. The number of suction flow paths connected to the first cyclone dust collector 51 and the second cyclone dust collector 52 is not limited to that shown in FIG. 5 or described above.

In this case, a plurality of suction flow paths connected to one cyclone dust collector may be respectively connected at different locations on the suction unit 30.

A plurality of suction flow paths are connected to one of the cyclone dust collectors 51 and 52 so that a suction force of the cyclone dust collector 51 may be improved. Also, compared to a case where one suction flow path is connected to one cyclone dust collector 51 or 52, a distance between suction flow paths connected to the suction unit 30 is decreased so that the problem in which there may be a portion of the suction port 15 having a weak suction force can be more effectively solved.

FIG. 6 is a view of a state in which a plurality of cyclone dust collectors are provided in the robot cleaner according to an embodiment of the present invention.

Referring to FIG. 6, three or more cyclone dust collectors 51, 52, and 53 may be provided in the robot cleaner 1 according to an embodiment of the present invention. The number of cyclone dust collectors 51, 52, and 53 and their installation positions are not limited to those shown in FIG. 6.

In this case, the structures and shapes of the cyclone dust collectors 51, 52, and 53 may be similar. Three or more cyclone dust collectors 51, 52, and 53 are provided so that foreign substances on the floor surface may be effectively suctioned and collected.

Also, a plurality of suction flow paths 41, 42, and 43 that connect each of the cyclone dust collectors 51, 52, and 53 and the suction unit 30 are connected to the suction unit 30 while being spaced a predetermined distance apart from one another so that there may be no portion of the suction port 15 having a weak suction force and the foreign substances on the floor surface may not be well suctioned. Thus, the foreign substances on the floor surface may be equally and well suctioned into the whole of the suction port 15.

FIG. 7 is a view of a state in which cyclone dust collectors having different sizes are provided in the robot cleaner according to an embodiment of the present invention.

Referring to FIG. 7, a plurality of cyclone dust collectors 51, 52, 53, 54, and 55 may be provided in the robot cleaner 1 according to an embodiment of the present invention. The plurality of cyclone dust collectors 51, 52, 53, 54, and 55 may have different sizes. The plurality of cyclone dust collectors 51, 52, 53, 54, and 55 having different sizes may suction foreign substances having different sizes. For example, a cyclone dust collector having the largest size may suction foreign substances having large sizes from the floor surface, and a cyclone dust collector having the smallest size may suction foreign substances having small sizes from the floor surface.

For example, the plurality of cyclone dust collectors 51, 52, 53, 54, and 55 may include a first cyclone dust collector 51, a second cyclone dust collector 52 having a larger size than that of the first cyclone dust collector 51, a third cyclone dust collector 53 having a larger size than that of the second cyclone dust collector 52, a fourth cyclone dust collector 54 having a smaller size than that of the third cyclone durst collector 53, and a fifth cyclone dust collector 55 having a smaller size than that of the fourth cyclone dust collector 54.

Here, the third cyclone dust collector 53 having the largest size may be disposed in the middle of the plurality of cyclone dust collectors 51, 52, 53, 54, and 55. That is, the first cyclone dust collector 51 and the second cyclone dust collector 52 may be disposed at one side of the third cyclone dust collector 53, and the fourth cyclone dust collector 54 and the fifth cyclone durst collector 55 may be disposed at the other side of the third cyclone dust collector 53. The second cyclone dust collector 52 and the fourth cyclone dust collector 54 may be disposed adjacent to the third cyclone dust collector 53, and the first cyclone dust collector 51 and the fifth cyclone dust collector 55 may be respectively disposed adjacent to the second cyclone dust collector 52 and the fourth cyclone dust collector 54.

The third cyclone dust collector 53 having the largest size may suction the foreign substances having relatively large sizes from the floor surface. The first cyclone dust collector 51 or the fifth cyclone dust collector 55 having the smallest sizes may suction the foreign substances having relatively small sizes from the floor surface.

At least one of the suction flow paths 41, 42, 43, 44, and 45 connected to the suction unit 30 may be connected to each of the plurality of cyclone dust collectors 51, 52, 53, 54, and 55. The suction flow paths 41, 42, 43, 44, and 45 may be spaced a predetermined distance apart from one another and respectively connected at different locations on the suction unit 30. Thus, compared to a case where one suction flow path is connected to the suction unit 30, a portion having a weak suction force may be prevented from occurring in the suction port 15. Thus, the foreign substances on the floor surface may be equally suctioned into the whole of the suction port 15.

In FIG. 7, an embodiment in which five cyclone dust collectors are provided, has been described. However, the number of cyclone dust collectors and their installation positions are not limited to those shown in FIG. 7.

FIG. 8 is a view of a state in which a valve is mounted in a suction flow path connected to a plurality of cyclone dust collectors provided in the robot cleaner according to an embodiment of the present invention.

Referring to FIG. 8, the robot cleaner 1 according to an embodiment of the present invention may include a plurality of cyclone dust collectors 50 and a valve 70 connected to a controller for controlling on/off so that the air may be suctioned into or may not be suctioned into each of the plurality of cyclone dust collectors 50. A plurality of valves 70 may be provided in the suction flow paths 41, 42, 43, 44, and 45 connected to the cyclone dust collectors 51, 52, 53, 54, and 55, respectively. The user may turn on or off the valve 70 using a remote control unit or a manipulation unit disposed in the robot cleaner 1. The valve 70 may be turned on/off based on information detected by a sensor for detecting the foreign substances on the floor surface. The cyclone dust collector connected to the suction flow path in which the valve 70 is turned on, may be controlled to collect dust by suctioning the foreign substances on the floor surface, and the cyclone dust collector connected to the suction flow path in which the valve 70 is turned off, may be controlled in such a way that the air and the foreign substances on the floor surface may not be suctioned by the suction flow path.

For example, when the robot cleaner 1 includes the plurality of cyclone dust collectors 51, 52, 53, 54, and 55 having different sizes, if foreign substances having large sizes are mainly on the floor surface depending on a state of the floor surface on which cleaning is to be performed by the robot cleaner 1, cleaning may be performed in a state in which a valve 73 connected to the cyclone dust collector 53 having a large size is turned on and valves 71, 72, 74, and 75 connected to the cyclone dust collectors 51, 52, 54, and 55 having small sizes are turned off.

When foreign substances having small sizes are mainly on the floor surface, cleaning may be performed in a state in which the valve 73 connected to the cyclone dust collector 53 having a large size is turned off and the valves 71, 72, 74, and 75 connected to the cyclone dust collectors 51, 52, 54, and 55 having small sizes are turned on or in a state in which only the valves 72 and 74 connected to the cyclone dust collectors 52 and 54 having intermediate sizes are turned on or only the valves 71 and 75 connected to the cyclone dust collectors 51 and 55 having small sizes are turned on. Also, if necessary, the floor surface may be cleaned in a state in which all of the valves 71, 72, 73, 74, and 75 connected to the cyclone dust collectors 51, 52, 53, 54, and 55 are turned on.

In this way, the valve 70 that may turn on/off each of the plurality of cyclone dust collectors is provided so that a part or the whole of the cyclone dust collectors is driven according to the state of the floor surface and thus the floor surface may be cleaned.

FIG. 9 is a view of a state in which partition walls are provided in the inlet of the robot cleaner according to an embodiment of the present invention.

Referring to FIG. 9, a space of the suction port 15 of the robot cleaner 1 according to an embodiment of the present invention may be partitioned by one or more partition walls 31 and 32. One suction flow path may be connected to the space partitioned by the partition walls 31 and 32. The suction force in one suction flow path may not interfere with the suction force in another adjacent suction flow path due to the partition walls 31 and 32.

In detail, one or more partition walls 31 and 32 may be provided inside the suction unit 30 provided at the suction port 15 and may partition the internal space of the suction unit 30. When a first suction flow path 41, a second suction flow path 42 and a third suction flow path 43 are connected to the suction unit 30, the internal space of the suction unit 30 may be partitioned into a first suction space 150*a* to which the first suction flow path 41 is connected, a second suction space 150*b* to which the second suction flow path 42 is connected, and a third suction space 150*c* to which the third suction flow path 43 is connected, by two partition walls 31 and 32.

In this way, the internal space of the suction unit 30 is partitioned by the partition walls 31 and 32 so that the suctioned air and foreign substances in one of the plurality of suction flow paths and the suctioned air and foreign substances in another one of the plurality of suction flow paths adjacent to the one suction flow path may not interfere with each other and may be suctioned through each partitioned space.

FIG. 10 is a view of a state in which a discharge flow path is connected to an inlet of the robot cleaner according to an embodiment of the present invention.

Referring to FIG. 10, the robot cleaner 1 according to an embodiment of the present invention may include discharge circulation flow paths 81 and 82 connected to the fan motor 20. The discharge circulation flow paths 81 and 82 may connect a rear end of the fan motor 20 and the suction unit 30. The discharge circulation flow paths 81 and 82 extend to the suction port 15 from the fan motor 20 so that the air suctioned into the fan motor 20 may be guided to move to the suction port 15. For example, the discharge circulation flow paths 81 and 82 each may be connected to one side of the suction unit 30. The discharge circulation flow paths 81 and 82 are connected to the suction unit 30 so that a suction force at the suction port 15 may be enhanced.

In detail, the foreign substances of the air suctioned in the suction flow paths 41, 42, and 43 may be accommodated in the plurality of cyclone dust collectors, and the air from which the foreign substances are filtered, may be discharged to the fan motor 20 due to the discharge flow path connected to the fan motor 20. The air discharged to the fan motor 20 may be introduced into the internal space of the suction unit 30 due to the discharge circulation flow paths 81 and 82 connected to the suction unit 30. In this case, the suction force of the fan motor 20 in the suction flow paths 41, 42, and 43 may act as a force for discharging the air in the discharge circulation flow paths 81 and 82. In the suction flow paths 41, 42, and 43, the suction force of the fan motor 20 and the force for discharging the air in the discharge circulation flow paths 81 and 82 are added to each other so that the air may be suctioned in the suction flow paths 41, 42, and 43. Thus, when the discharge circulation flow paths 81 and 82 are provided, the suction force in the suction unit 30 may be increased by the force for discharging the air in the discharge circulation flow paths 81 and 82.

FIG. 11 is a view of a state in which a plurality of cyclone dust collectors provided in the robot cleaner, according to another embodiment of the present invention, share a foreign substance collecting unit, and FIG. 12 is a cross-sectional view of the plurality of cyclone dust collectors of the robot cleaner that share the foreign substance collecting unit, according to another embodiment of the present invention.

Referring to FIGS. 11 and 12, a cyclone dust collector 50' provided in the robot cleaner 1, according to another embodiment of the present invention may share a foreign substance collecting unit 500. The cyclone dust collector 50' may be connected to a suction unit 30' by a plurality of suction flow paths 40'.

The cyclone dust collector 50' may be provided when a plurality of cyclone units are accommodated in a dust box 510'. The foreign substance collecting unit 500 may be a space formed between the plurality of cyclone units and the dust box 510'. Hereinafter, an embodiment in which a first cyclone unit 56 and a second cyclone unit 57 are accommodated in the dust box 510', will be described.

The first cyclone unit 56 includes a first cylindrical body 560 and a second cylindrical body 561 accommodated in the first cylindrical body 560. The first cylindrical body 560 and the second cylindrical body 561 may be formed approximately concentric. At least a part of the second cylindrical body 561 may be provided in the form of a grill part. A plurality of through holes 561*b* may be formed in the grill part so that air may pass through the plurality of through holes 561*b*.

A space between the dust box 510' and the first cylindrical body 560 may be referred to as the foreign substance collecting unit 500, and a space between the first cylindrical body 560 and the second cylindrical body 561 may be referred to as a first chamber 560*a*, and a space in the second cylindrical body 561 may be referred to as a second chamber 561*a*. The foreign substance collecting unit 500 may be shared by the first cyclone unit 56 and the second cyclone unit 57.

A suction flow path 41' may communicate with the first chamber 560*a*, and the second chamber 561*a* may communicate with a first discharge flow path 61'. An inlet 410' through which air is introduced into the first chamber 560*a* from the suction flow path 41', may be disposed at a lower side of the first chamber 560*a*.

The air introduced into the first chamber 560*a* due to a suction force of the fan motor 20' may turn along inner sidewalls of the first cylindrical body 560. The foreign substances in the air may be moved to the foreign substance collecting unit 500 and accommodated therein, and the air from which the foreign substances are filtered, may be introduced into the third chamber 561*a* through the through holes 561*b* formed in the second cylindrical body 561. The air introduced into the third chamber 561*a* may be discharged through the first discharge flow path 61'. The air from which the foreign substances are filtered by the first cyclone unit 56, may move to the fan motor 20' and may be discharged to the outside through the first discharge flow path 61'.

The second cyclone unit 57 has a similar configuration to that of the first cyclone unit 56. The second cyclone unit 57 includes a first cylindrical body 570 and a second cylindrical body 571 accommodated in the first cylindrical body 570. The first cylindrical body 570 and the second cylindrical body 571 may be formed approximately concentric. At least a part of the second cylindrical body 571 may be provided in the form of a grill part. A plurality of through holes 571*b* are formed in the grill part so that air may pass through the plurality of through holes 571*b*.

A space between the dust box 510' and the first cylindrical body 570 may be referred to as the foreign substance collecting unit 500, and a space between the first cylindrical body 570 and the second cylindrical body 571 may be referred to as a first chamber 570*a*, and a space inside the second cylindrical body 571 may be referred to as a second chamber 571*a*.

The suction flow path 42' may communicate with the first chamber 570*a*, and the second chamber 571*a* may communicate with the second discharge flow path 62'. An inlet 420' through which the air is introduced from the suction flow path 42' may be disposed at a lower side of the first chamber 570*a*.

The air introduced into the first chamber 570*a* through the suction flow path 42' due to the suction force of the fan motor 20', may turn along the inner sidewalls of the first cylindrical body 570. The foreign substances in the air may be moved to the foreign substance collecting unit 500 and accommodated therein, and the air from which the foreign substances are filtered, may be introduced into the third chamber 571*a* through the through holes 571*b* formed in the second cylindrical body 571. The air introduced into the third chamber 571*a* may be discharged through the second discharge flow path 62'. The air from which the foreign substances are filtered by the second cyclone unit 57, may move to the fan motor 20' and may be discharged to the outside through the second discharge flow path 62'.

The suction flow paths 41' and 42' respectively connected to the cyclone units 56 and 57 are spaced a predetermined distance apart from each other and are connected to both sides of the suction unit 30' so that the suction performance at a suction port can be enhanced.

In this way, when a cyclone dust collector includes a plurality of cyclone units and the plurality of cyclone units share a foreign substance collecting unit, the size of the cyclone dust collector can be reduced so that the robot cleaner can be manufactured in a small size. The number of cyclone units that share the foreign substance collecting unit and the positions of the cyclone units are not limited to the above description.

The configuration of the robot cleaner illustrated in FIGS. 6 through 10 may also be applied to a robot cleaner including a cyclone dust collector having a plurality of cyclone units sharing a foreign substance collecting unit.

As described above, a plurality of cyclone dust collectors are provided in a robot cleaner so that the suction performance of the robot cleaner can be enhanced and simultaneously, the robot cleaner can be manufactured in a small size. In addition, a plurality of suction flow paths are provided so that the suction performance at both sides of the suction port can be prevented from being degraded, and a plurality of cyclone dust collectors having different sizes are provided, or the plurality of cyclone dust collectors are respectively controlled so that use convenience can be improved.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A robot cleaner comprising:

a main body comprising a fan motor that generates a suction force and having a suction port provided in one side thereof;

a plurality of cyclone units configured to separate foreign substances in air suctioned through the suction port; and at least one suction flow path connecting the plurality of cyclone units and the suction port, and configured to discharge air from the suction port directly to each of the plurality of cyclone units and a controller configured to control autonomous navigation and operations of the robot cleaner.

2. The robot cleaner of claim 1, wherein the at least one suction flow path is connected to a suction unit provided to communicate with the suction port.

3. The robot cleaner of claim 2, wherein the at least one suction flow path includes a plurality of suction flow paths that are connected to the plurality of cyclone units, and the plurality of suction flow paths are respectively connected at different locations on the suction unit.

4. The robot cleaner of claim 2, further comprising a discharge circulation flow path connecting a rear end of the fan motor and the suction unit.

5. The robot cleaner of claim 2, wherein a space of the suction unit is partitioned by partition walls.

6. The robot cleaner of claim 1, wherein the at least one suction flow path includes a plurality of suction flow paths that are connected to at least one of the plurality of cyclone units.

7. The robot cleaner of claim 1, wherein the plurality of cyclone units have different sizes to accommodate foreign substances having different sizes.

8. A robot cleaner comprising:

a main body comprising a fan motor that generates a suction force and having a suction port provided in one side thereof;

a plurality of cyclone units configured to separate foreign substances in air suctioned through the suction port;

at least one suction flow path connecting the plurality of cyclone units and the suction port; and a controller configured to control the plurality of cyclone units to be individually turned on/off.

9. The robot cleaner of claim 1, further comprising a discharge flow path connecting the plurality of cyclone units and a front end of the fan motor.

10. The robot cleaner of claim 1, wherein a filter is provided at a front end or rear end of the fan motor.

* * * * *